US005350287A

United States Patent [19]

Secord

[11] Patent Number: 5,350,287

[45] Date of Patent: Sep. 27, 1994

[54] ROTARY ENGINE AND CAM-OPERATED WORKING MEMBER ASSEMBLY

[76] Inventor: Denver Secord, R.R. #2, Oliver, British Columbia, Canada, V0H 1T0

[21] Appl. No.: 96,683

[22] Filed: Jul. 23, 1993

[51] Int. Cl.[5] ..... F01C 1/00

[52] U.S. Cl. ..... 418/245; 418/231; 418/211; 277/25

[58] Field of Search ..... 418/245, 231, 230, 209, 418/210, 211; 277/25

[56] References Cited

U.S. PATENT DOCUMENTS

| | | | |
|---|---|---|---|
| 627,832 | 6/1899 | Tichenor et al. | 418/217 |
| 777,417 | 5/1904 | Higgins | 418/211 |
| 808,255 | 12/1905 | Philippon | 418/207 |
| 861,725 | 7/1907 | Hooker | 418/231 |
| 910,175 | 1/1909 | Cole | 418/94 |
| 919,698 | 4/1909 | Crull | 418/231 |
| 920,911 | 5/1909 | Burhans . | |
| 1,028,466 | 6/1912 | Johnson . | |
| 1,261,128 | 4/1918 | Higgins . | |
| 1,349,520 | 8/1920 | McMillan . | |
| 1,874,247 | 8/1932 | Dalton | 418/245 |
| 1,949,723 | 3/1934 | Kotelevtseff | 418/227 |
| 2,182,719 | 12/1939 | Booth | 418/227 |
| 2,324,610 | 7/1943 | Williams | 418/244 |
| 2,550,849 | 5/1951 | Morris | 418/245 |
| 2,674,234 | 4/1954 | Riggle | 418/245 |
| 2,788,748 | 4/1957 | Szczepanek | 103/123 |
| 2,943,873 | 7/1960 | Hamm et al. | 277/25 |
| 3,240,157 | 3/1966 | Hinckley | 103/124 |
| 3,897,758 | 8/1975 | Humiston et al. | 418/245 |
| 4,451,214 | 5/1984 | Kagamiyawa | 418/245 |

FOREIGN PATENT DOCUMENTS

| | | |
|---|---|---|
| 681601 | 5/1930 | France . |
| 186509 | 5/1922 | United Kingdom . |
| 2233713A | 1/1991 | United Kingdom . |

*Primary Examiner*—Richard A. Bertsch
*Assistant Examiner*—Charles G. Freay
*Attorney, Agent, or Firm*—Wells, St. John, Roberts, Gregory & Matkin

[57] ABSTRACT

A rotary engine includes a stationary engine block and a power shaft mounted along a central axis for rotation with the engine block. An annular working chamber is formed in the engine about the central axis. A working member is connected to the power shaft to travel in a circular path about the central axis through the annular working chamber. The engine block has an elongated passage which extends through or across the annular working chamber in a direction perpendicular to the travel of the working member. An elongated bar is received within the elongated passage for slidable movement therethrough between first and second positions. The elongated bar includes a slot which is aligned with the annular working chamber when the elongated bar is in its first position to allow passage of the working member therethrough. The elongated bar forms a wall across the annular working chamber when the working member is in its second position to divide the annular working chamber into expansion and exhaust chambers.

27 Claims, 7 Drawing Sheets

ROTARY ENGINE AND CAM-OPERATED WORKING MEMBER ASSEMBLY

TECHNICAL FIELD

This description pertains to rotary engines and motors.

BACKGROUND OF THE INVENTION

Rotary engines and motors have not been widely accepted. Rotary engines as known today are mechanically complex. They have posed significant problems with respect to temperature control. Designers of such engines have also encountered difficulty in sealing between the rotary member and the associated stationary housing. The present invention has been directed toward solutions to these problems.

One form of a rotary engine utilizes a lobed rotor rotatably mounted within an enclosing housing to form a variable fluid volume working chamber in conjunction with intake and exhaust ports. A gate valve or partition member slidably engages the periphery of the rotor to prevent fluid from moving directly from the intake port to the exhaust port. Examples of prior U.S. patents that disclose such devices are U.S. Pat. No. 884,332, issued Apr. 7, 1908; U.S. Pat. No. 2,515,288, issued Jul. 18, 1950; U.S. Pat. No. 3,924,579, issued Dec. 9, 1975; U.S. Pat. No. 4,386,894, issued Jun. 7, 1983; and U.S. Pat. No. 4,599,059, issued Jul. 8, 1986.

FIGS. 1–4 illustrate, in diagrammatic form, the operational steps of a conventional rotary engine. Such an engine typically includes a cylindrical rotor 2 that rotates in a complementary-shaped rotor chamber within a stationary housing 1. The rotor chamber has a larger diameter than that of rotor 2, resulting in formation of an annular working chamber 6 about the periphery of rotor 2. Intake and exhaust ports 3 and 4, respectively, communicate with working chamber 6.

A movable partition member 5 protrudes through housing 1 into annular working chamber 6 to separate intake port 3 from exhaust port 4. Rotor 2 includes a land or lobe 7 which further divides working chamber 6 into expansion and exhaust chambers. The expansion chamber is formed behind lobe 7, in the portion of annular working chamber 6 which trails lobe 7. The exhaust chamber is formed ahead of lobe 7, in the portion of annular working chamber 6 which leads lobe 7.

During an initial portion of rotor rotation, shown in FIG. 1, combustible gas is drawn or forced into working chamber 6 through intake port 3. The combustion gases are ignited, driving rotor 2 in a clockwise direction. Spent gases from a previous combustion cycle are exhausted ahead of lobe 7 through exhaust port 4. FIG. 2 shows a subsequent portion of rotor rotation, in which lobe 7 is approaching exhaust port 4 and working member 5. In FIGS. 3 and 4, lobe 7 has pushed working member 5 upwardly so that lobe 7 can pass thereunder. The cycle is repeated to produce continuous rotational motion.

Passage of pressurized gas directly from intake port 3 to exhaust port 4 is prevented by partition member 5 which is radially movable. It yieldably rides along the periphery of the rotor 2.

Sealing the sliding partition member, both against its seat and against the rotor, presents practical problems. Supporting the partition member against the forces of combustion presents another practical problem. In the prior art, the sealing partition member is held against the rotor periphery by yieldable biasing forces supplied by springs. However, this often results in unacceptable frictional forces between the rotor and the partition member. Furthermore, at high rotor speeds the engaging pressure of the partition member is subject to substantial variation. Such pressure in many cases is insufficient to completely close the partition member against the rotor. One object of this disclosure is to provide positive displacement controls to the partition member rather than the yieldable displacement control of previous devices. The invention described herein also provides improved opportunities for sealing the interface between the partition member, the working chamber, and the rotor, and for supporting the partition member against the explosive forces of internal combustion within the working chamber.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts." U.S. Constitution, Article 1, Section 8.

Figure 5:
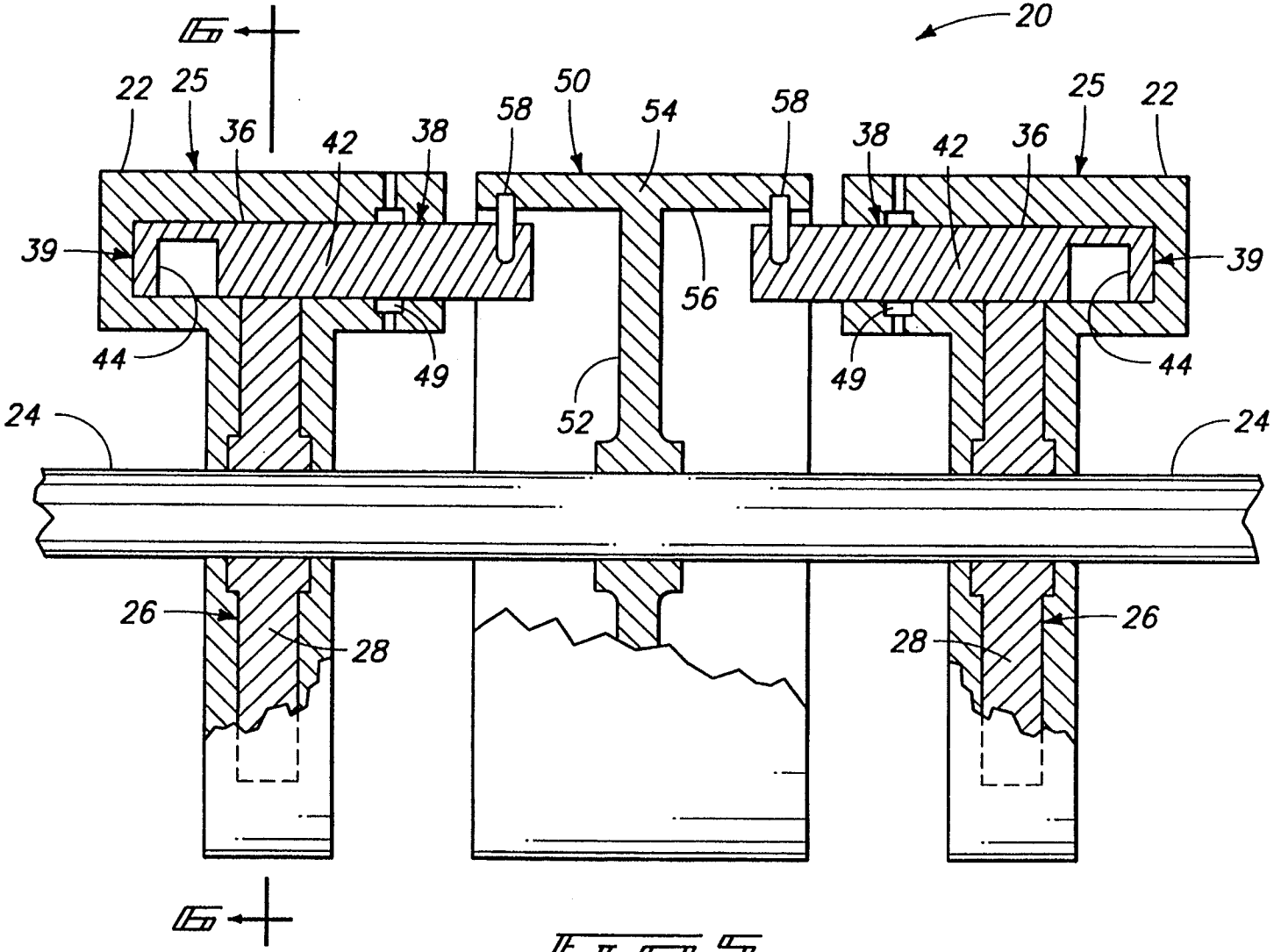
FIG. 5 is a sectional view of a rotary engine in accordance with a preferred embodiment of the invention.
Figure 6:
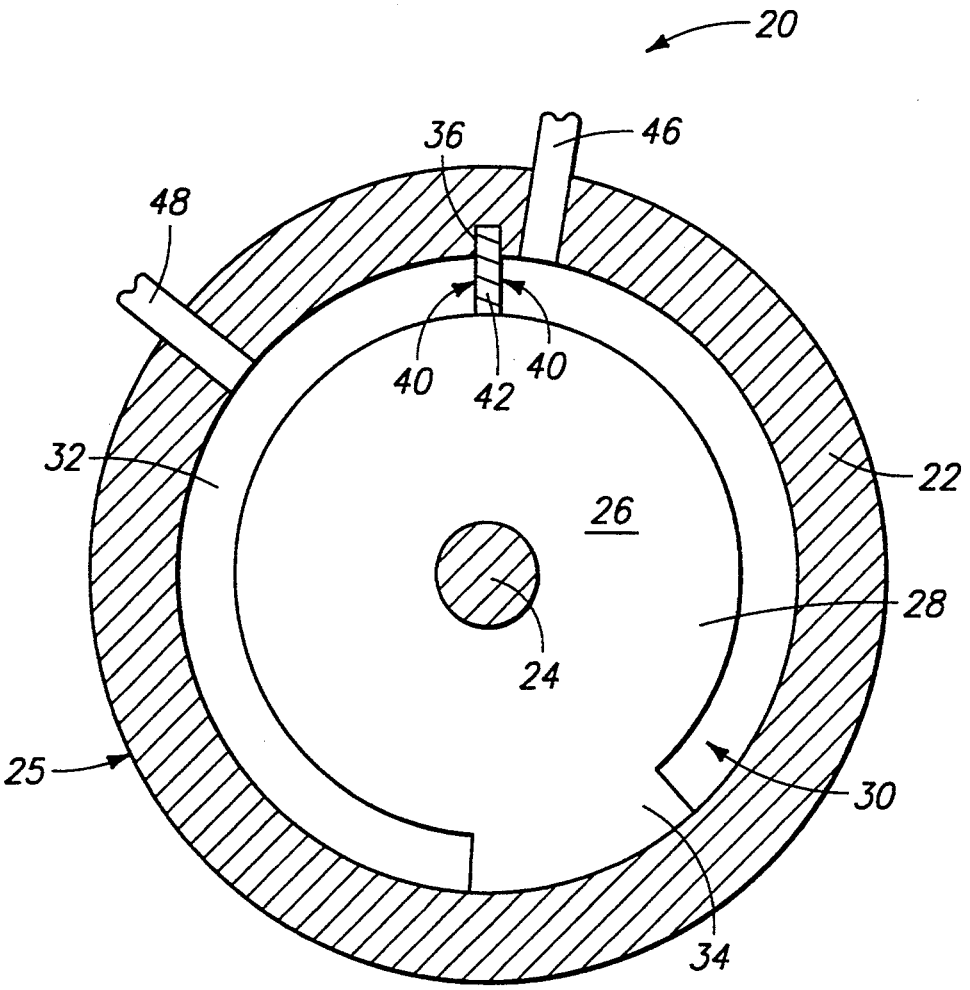
FIG. 6 is a cross-sectional view of the rotary engine of FIG. 5, taken along the line 6—6 of FIG. 5.

Referring now to FIGS. 5 and 6, a rotary engine 20 is shown in accordance with a preferred embodiment of the invention. Rotary engine 20 includes a pair of rotor assemblies 25. Each rotor assembly 25 comprises a stationary engine block or housing 22. A power shaft 24 is mounted coaxially about a central axis for rotation within and relative to both engine blocks 22. Power shaft 24 preferably has internal oil passages (not shown) for communicating lubricating and cooling fluids to various rotational members described below. Power shaft 24 is preferably formed by a pair of concentric shafts, forming an annular oil passage therebetween to the rotor. Passages in the rotor further communicate cooling fluids as needed.

A pair of rotors 26 are connected to power shaft 24 to rotate with power shaft 24. Each rotor 26 comprises a central disk 28 which is coaxial with the central axis of power shaft 24. More specifically, power shaft 24 is received through the center of central disk 28 so that disk 28 spins with rotation of power shaft 24.

Engine block or housing 22 forms a cylindrically-shaped internal void or rotor chamber 30 which is complementary in width and general shape to rotor 26. Rotor 26 is received within rotor chamber 30. Rotor chamber 30 has a diameter which is greater than the diameter of rotor 26. This forms an annular working chamber 32 about the central axis of power shaft 24, between the outer periphery of central disk 28 and the inner periphery or walls of rotor chamber 30.

Rotor 26 includes a working member positioned to travel in a circular path about the central axis through annular working chamber 32. The working member is formed by a lobe or land 34 which is positioned radially outward of central disk 28 along an arc of the central disk's outer periphery. Lobe 34 has an outer peripheral surface which seals against the inner periphery of annular working chamber 32. Lobe 34 preferably extends approximately 60 degrees about rotor 26.

Engine block 22 has an elongated passage 36 which extends through annular working chamber 32 in a direction perpendicular to the travel of lobe 34. Elongated passage 36 is preferably oriented parallel to power shaft 24. Elongated passage 36 includes a first or proximal portion 38 on a proximal side of annular working chamber 32 and a second or distal portion 39 on a distal or opposite side of annular working chamber 32. Elongated passage 36 has a rectangular cross-section, including parallel opposed sides 40 which are transversely spaced from each other in relation to the central axis.

An elongated partition member or rectangular bar 42 is mounted within engine block 22 to extend across annular working chamber 32. Partition member 42 forms a rigid gate valve assembly which is slidably received within elongated passage 36 to reciprocate in a direction perpendicular to the travel of lobe 34. Partition member 42 preferably slides between first and second positions in a direction parallel with the central axis. Partition member 42 has a length which is sufficient to span the annular working chamber in both its first and second positions. More specifically, partition member 42 extends beyond opposed sides of annular working chamber 32. It is received within both the proximal and distal portions of elongated passage 36 when partition member 42 is in its first position and also when it is in its second position.

Elongated partition member 42 has opposed parallel planar surfaces which are in sliding contact with parallel opposed sides 40 of elongated slot 36. A slot 44 is formed across partition member 42 between its opposed parallel surfaces at an intermediate longitudinal position along the partition member. Slot 44 extends through partition member 42 in the direction of the working member's travel, generally transverse to the central axis of power shaft 24. Slot 44 is sized and shaped to allow passage therethrough of working member 34 when partition member 42 is in its first position. However, the slot is located in partition member 42 so that partition member 42 forms a wall across annular working chamber 32 when partition member 42 is in its second position.

In its second position, partition member 42 divides annular working chamber 32 into expansion and exhaust chambers. The expansion chamber is formed in the portion of annular working chamber 32 which trails working member 34, between working member 34 and partition member 42. The exhaust chamber is formed in the portion of annular working chamber 32 which leads working member 34, also between working member 34 and partition member 42.

FIG. 5 shows partition member 42 in its second position. Accordingly, partition member slot 44 is completely within distal portion 39 of elongated slot 36. The solid portion of partition member 42 spans annular working chamber 32 in this position. In the first position of partition member 42, not shown, partition member slot 44 is aligned with annular working chamber 32 to allow passage of working member 34. However, the distal end of partition member 42 still extends into distal portion 39 of elongated slot 36 to provide transverse support for the partition member.

Intake and exhaust ports 46 and 48, respectively, are provided to communicate fuel and gases to and from working chamber 32. Ports 46 and 48 are valved in synchronization with the rotation of rotor 26.

Engine block 22 includes an oil bath 49 positioned around partition member 42 in proximal end 38 of elongated passage 36 to both lubricate and cool partition member 42 and elongated passage 36. Partition member 42 passes through oil bath 49 as it reciprocates between its first and second positions.

As shown in FIG. 5, an engine in accordance with the invention preferably comprises two rotor assemblies 25 mounted on opposite ends of a single power shaft 24. In this configuration, the working members 34 of each rotor 26 are angularly aligned with each other with respect to the central axis. This balances combustion forces and prevents torsional forces from being created between the two rotors.

A cam wheel 50 is connected to power shaft 24 between the two rotor assemblies 25 for rotation with power shaft 24. Cam wheel 50 comprises a circular inner rim 52 which extends radially outward from power shaft 24. Inner rim 52 supports a cylindrical outer drum 54. Outer drum 54 has a pair of inwardly-facing surfaces 56 on either side of inner rim 52. A guide slot 58 is formed in each of surfaces 56.

Elongated passage 36 is open at its proximal end 38. As shown, partition member 42 extends out from engine block 22 through elongated passage 36 toward cam wheel 50. Partition member 42 is thus positioned within the inwardly-facing surface 56 of outer drum 54. A guide projection or pin 58 extends from the proximal end of partition member 42, to be slidably received within guide slot 58. Guide slot 58 is positioned about surface 56 of outer drum 54 to oscillate or reciprocate partition member 42 between its first and second positions to align slot 44 with working member 34 as working member 34 passes through the top of its stroke, and to position slot 44 within distal end 39 of the elongated slot during other periods of rotor rotation. Partition member 42 is received within both the proximal and distal portions of elongated passage 36 at all times during its reciprocation.

Two rotor assemblies utilizing a common power shaft are shown and described above. However, a preferred implementation of the invention might also include more than one power shaft and associated rotor assemblies, such as two power shafts and four rotor assemblies as shown in FIG. 7.

Figure 7:
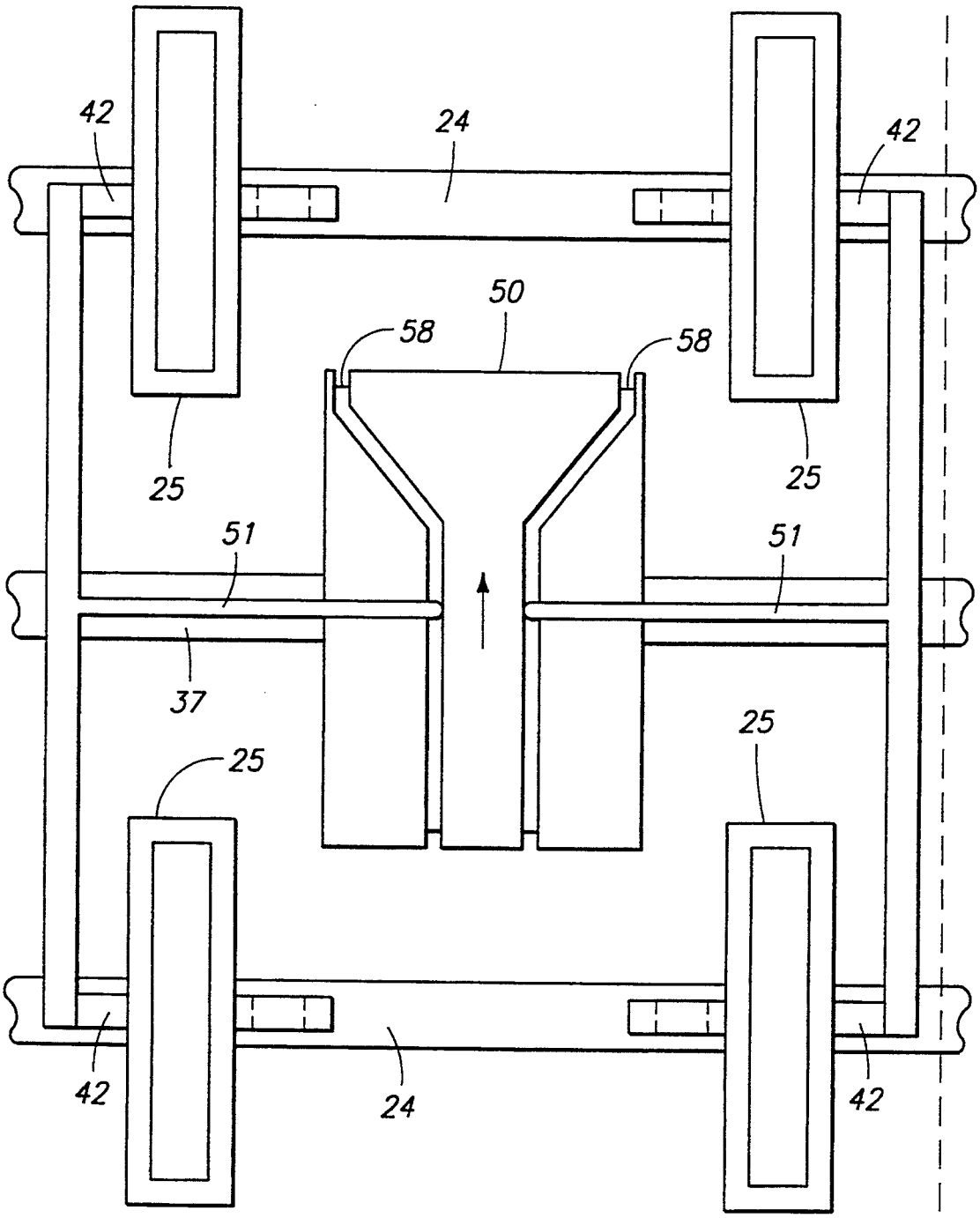
FIG. 7 is a diagrammatic view showing a plurality of rotor assemblies such as those shown in FIGS. 5 and 6.

The apparatus of FIG. 7 includes a pair of power shafts 24 and a pair of rotor assemblies 25 associated with each power shaft 24. Each rotor assembly includes a partition member 42. The power shafts are geared together for synchronous movement in opposite rotational directions. Alternatively, the power shafts could be connected together by a chain drive rather than a gear assembly. The opposite rotational directions of the power shafts and associated rotor assemblies serves to offset vibration caused by the centrifugal forces of the working members and by the combustion itself within the working chambers. Ignition in all working chambers is initiated simultaneously to further offset vibration and to transfer the opposing forces of exploding gases to the rigid partition members 42.

A separate cam shaft 37 is geared to the power shafts for synchronous rotation therewith. A cam wheel 50 is mounted to cam shaft 37. The cam wheel includes guide slots 58 as described above. Partition member actuators 51 are slidably positioned to engage the cam wheel guide slots and to also engage partition members 42. Cam wheel 50 thus reciprocates the partition members between their first and second positions. Such reciprocation can alternatively be accomplished by utilizing a horizontal flywheel and connecting rods attached to each partition member.

Figure 2:
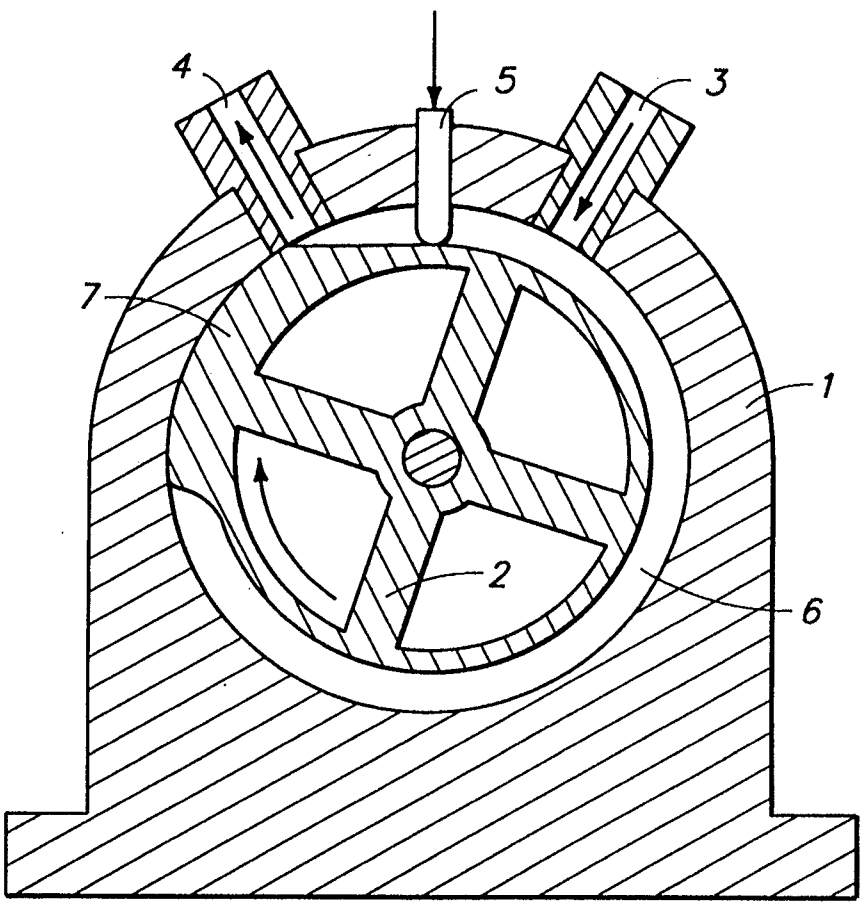
FIG 2 PRIOR ART
FIGS. 1 through 4 are a series of diagrammatic views illustrating progressive operation of a prior art rotary engine.
Figure 1:
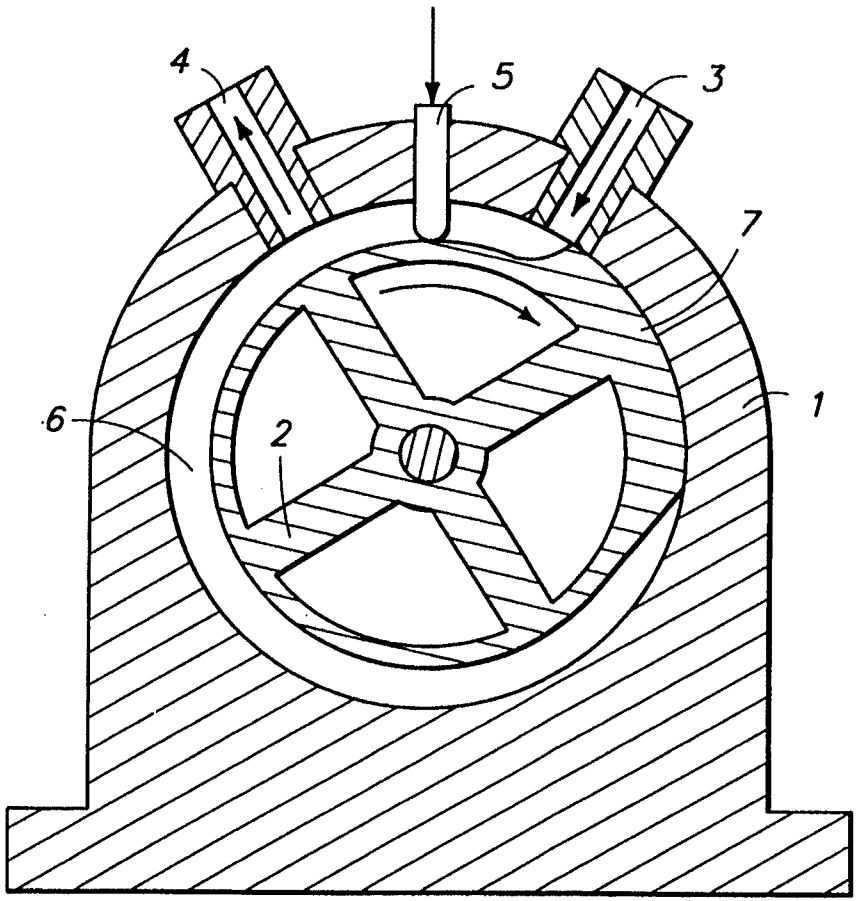
FIG 1 PRIOR ART
Figure 4:
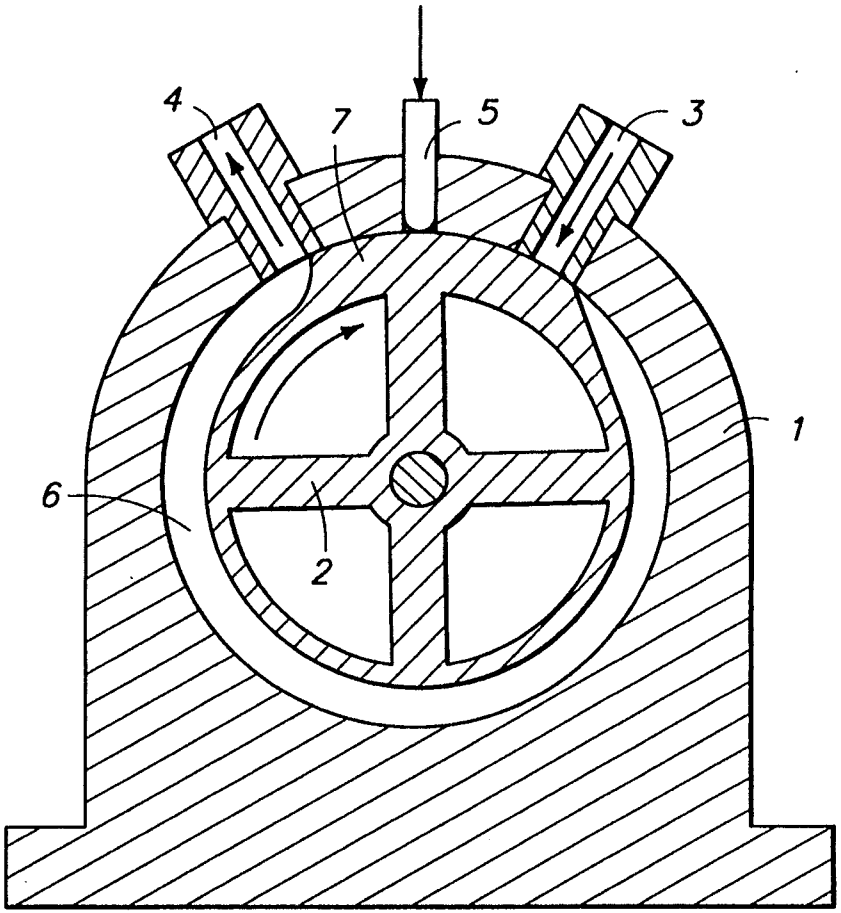
FIG 4 PRIOR ART
Figure 3:
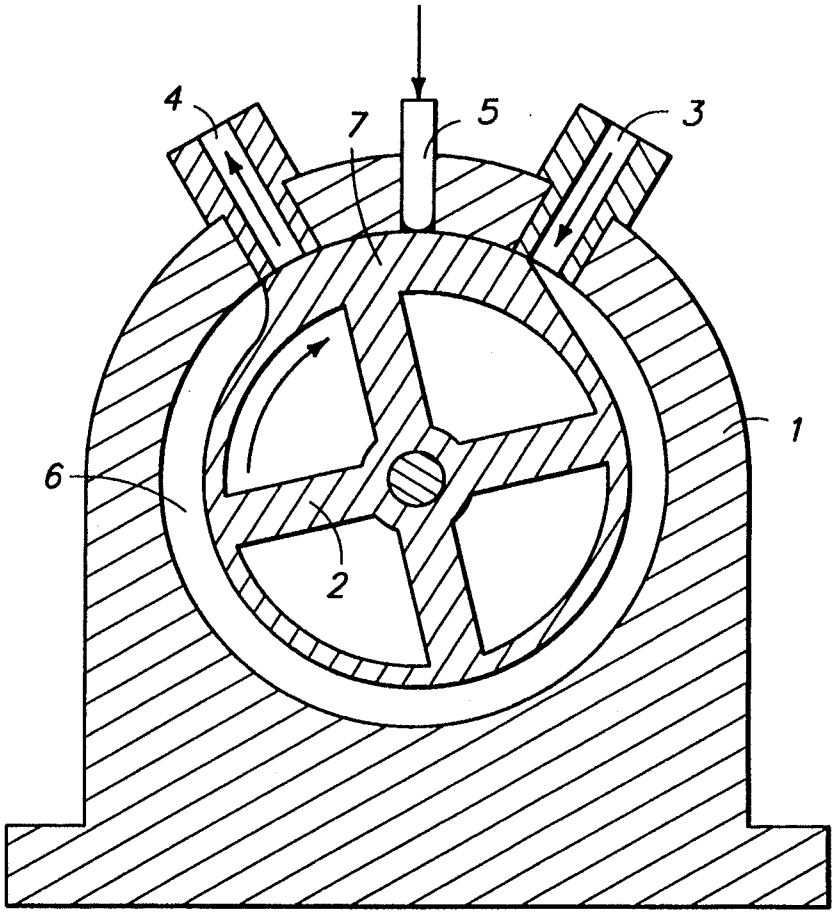
FIG 3 PRIOR ART
Figure 8:
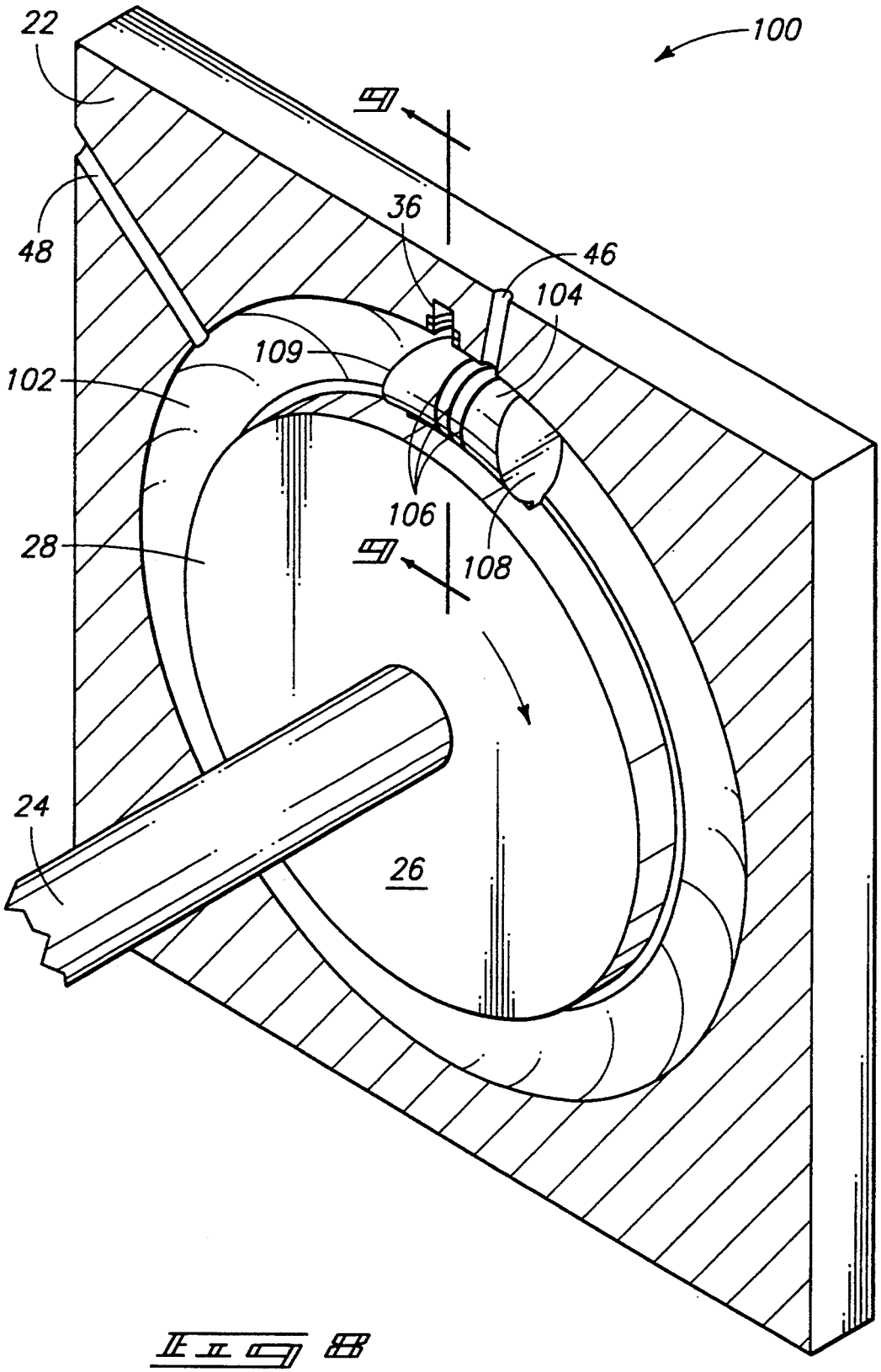
FIG. 8 is an isometric view of a portion of a rotary engine in accordance with an alternative embodiment of the invention.
Figure 9:
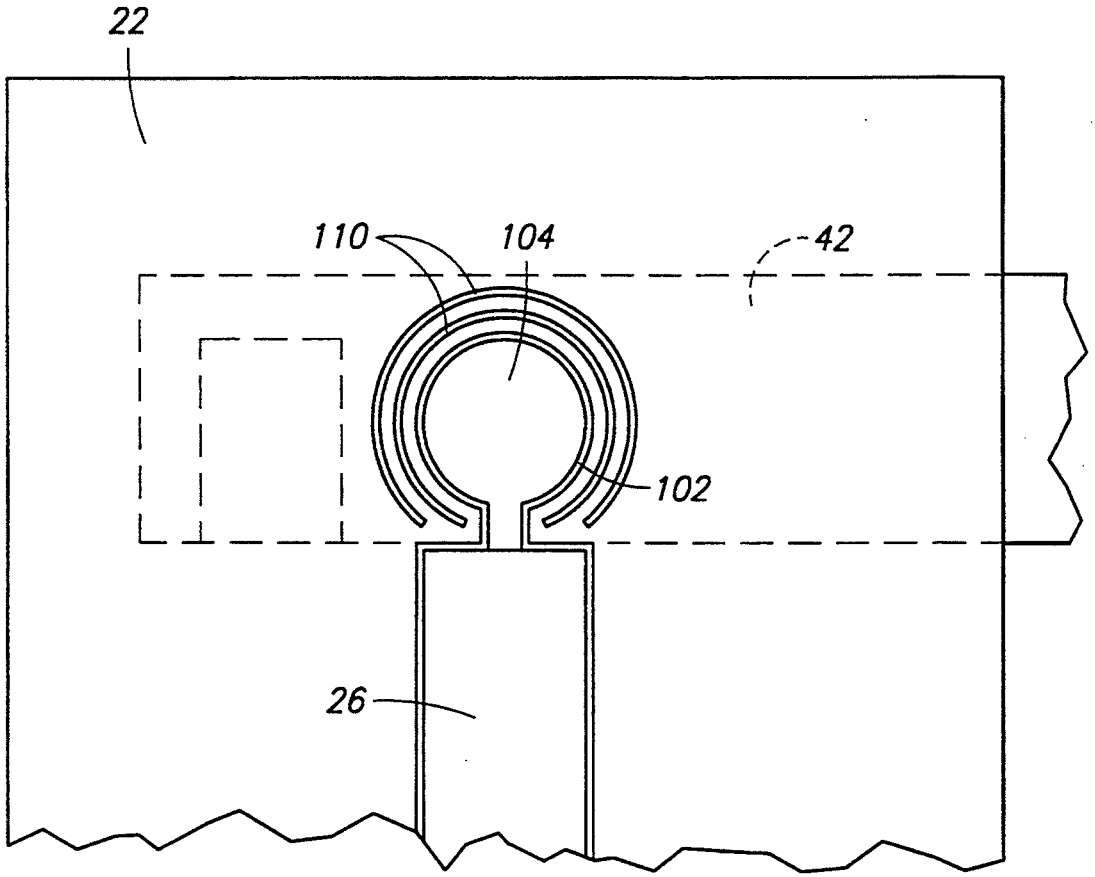
FIG. 9 is a sectional view of the rotary engine of FIG. 8, taken along the line 8—8 of FIG. 8.

FIGS. 8 and 9 show a rotor assembly 100 in accordance with an alternative embodiment of the invention. The alternative embodiment is similar to the rotor assembly 25 shown in FIGS. 4 and 5. Accordingly, identical reference numerals are used to designate corresponding components in the various figures.

Rotor assembly 100 differs from rotor assembly 25 of FIGS. 5 and 6 primarily in the cross-dimensional shapes of its annular working chamber and its working member. Specifically, rotor assembly 100 has an annular working chamber 102 with a circular cross-section. This results in working chamber 102 having a toroidal shape. Rotor assembly furthermore has a working member 104 with a circular cross-section approximately complementary in diameter to annular or toroidal working chamber 102.

The circular cross-sections of working chamber 102 and working member 104 facilitate sealing around the periphery of working member 104 as it travels through toroidal working member 104. Specifically, one or more sealing rings 106 are positioned in grooves around working member 104 to create a sliding seal between working member 104 and the circular or cylindrical walls or working chamber 102.

FIG. 8 shows that the working member 104 has a leading surface 108 and a trailing surface 109. These surfaces are angled or beveled so that leading surface 108 gradually enters partition member slot 44 as partition member 42 slides to its first position, and so that trailing surface 109 gradually exits partition member slot 44 as partition member 42 slides to its second position. This allows much closer timing between partition member 42 and working member 104 than would otherwise be possible.

FIG. 9 shows one preferred sealing arrangement between partition member 42 and elongated slot 36. As discussed above, partition member 42 is a rectangular bar having opposed planar bearing surfaces. One or more seals 110 are positioned in the facing opposed sides 40 of elongated slot 36 to contact and seal against partition member 42 as it reciprocates relative to seals 110. Seals 110 are preferably biased outwardly, toward elongated bar 42. Even more preferably, magnets (not shown) are positioned within working member 42 to draw seals 110 into more forceful contact with the planar bearing surfaces of partition member 42.

The effectiveness of sealing rings 106 can be enhanced by incorporation within working member 104 of counterweight devices. Such counterweight devices are connected to inner and outer ring segments to offset centrifugal forces.

Figure 10:
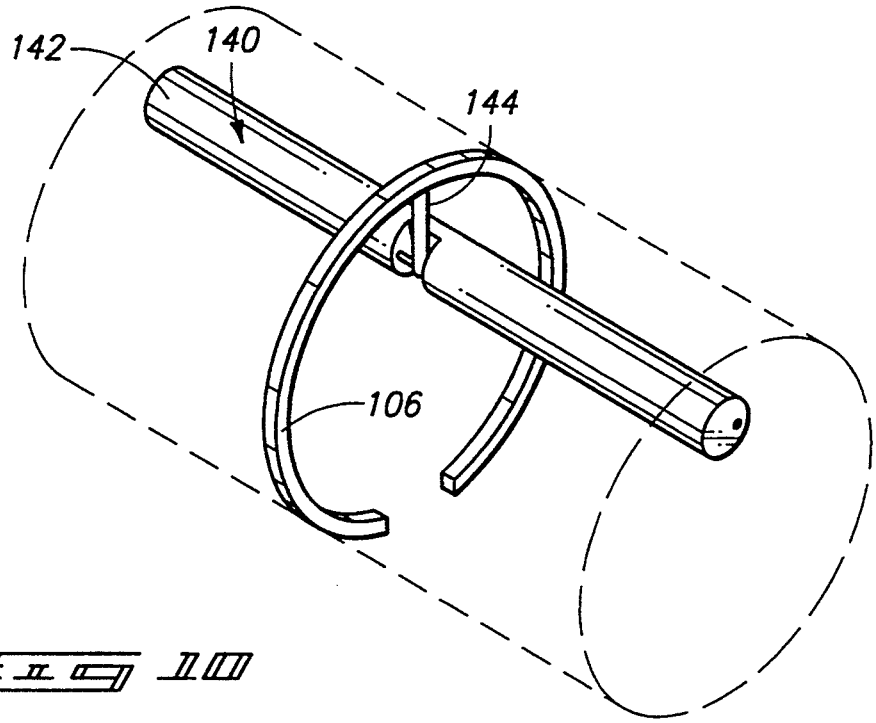
FIG. 10 is a diagrammatic view of a sealing ring counterweight assembly in accordance with a preferred embodiment of the invention.

FIG. 10 shows one example of such a counterweight assembly, generally designated by the reference numeral 140. It comprises one or more cylindrical counterweights 142 mounted within a complementary bore in working member 104 to allow rotation of cylindrical counterweights 142. One or more support arms 144 extend outward from a first side of each counterweight 142 and are connected to a segment of sealing ring 106. A second or opposite side of each counterweight 142 is weighted in relation to the first side. Upon rotation of working member 104, this weighted portion of counterweights 142 offsets the centrifugal forces produced by the corresponding sealing ring segments. Counterweight assemblies such as this can be placed to correspond to inner and outer segments of sealing rings 106.

In operation, combustible gases are ported under pressure into working chamber 32 through intake port 46 and ignited while partition member 42 is in its second position. This urges rotor 26 in a clockwise direction, while spent gases are exhausted through exhaust port 48. As working member 104 approaches partition member 42, partition member 42 moves into its first position to allow passage of working member 104 therethrough, whereupon the cycle is repeated.

The rotary engine of this invention incorporates various internal oil ducts for purposes of both cooling and lubrication. The various components are contained within a closed housing so that used oil can be collected in a sump and recycled through the engine.

The rotary engines described above have several significant advantages over prior art rotary engines. The most significant advantages relate to sealing. Inadequate sealing has been the downfall of many rotary engine designs. In contrast, the design described above provides effective sealing in two crucial areas: between the working member and the inner walls of the working chamber; and between the sliding partition member and its surrounding walls.

A further advantage relates to the unique physical characteristic of the working member of the invention, as opposed to the working member of previous efforts as typified by FIGS. 1–4. Previous engines have not provided positive positional control of their working members, resulting in speed limitations due to the inability of biasing devices to quickly recover. Furthermore, previous working members have been supported only at one end, resulting in structural weakness. The invention described above, on the other hand, provides a positive translational drive for the working member, allowing much higher speeds to be attained. Furthermore, the working member is supported on both of its ends during all phases of operation. This enhanced support reduces wear and fatigue, while also increasing the longevity of seals and bearing surfaces.

In compliance with the statute, the invention has been described in language more or less specific as to structural features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A rotary engine comprising:

an engine block having an annular working chamber formed about a central axis;

a power shaft mounted coaxially about the central axis for rotation within the engine block;

a rotor connected to the power shaft, the rotor including a working member positioned to travel in a circular path about the central axis through the annular working chamber;

a partition member mounted within the engine block to extend across the annular working chamber, the partition member being slidable between first and second positions in a direction perpendicular to the travel of the working member, the partition member spanning the annular working chamber in both the first and second positions;

the partition member including a slot which is aligned with the annular working chamber when the partition member is in its first position to allow passage of the working member therethrough; and the partition member further including a solid wall which is aligned with the annular working chamber when the partition member is in its second position, the partition member thereby dividing the annular working chamber into expansion and exhaust chambers;

the working member having a leading surface and a trailing surface, the leading and trailing surfaces being angled so that the leading surface gradually enters the partition member slot as the partition member slides to its first position and so that the trailing surface gradually exits the partition member slot as the partition member slides to its second position.

2. A rotary engine as recited in claim 1, the annular working chamber and the working member having circular cross-sections of complementary diameter.

3. A rotary engine as recited in claim 1, the annular working chamber and the working member having circular cross-sections of complementary diameter, the rotary engine including circular sealing rings positioned around the working member to seal between the working member and the annular working chamber.

4. A rotary engine as recited in claim 1, the annular working chamber and the working member having circular cross-sections of complementary diameter, the rotary engine further comprising:

circular sealing rings positioned around the working member to seal between the working member and the annular working chamber;

counterweight assemblies connected to segments of the circular sealing rings to offset centrifugal forces produced by the sealing ring segments.

5. A rotary engine as recited in claim 1, further comprising a cam wheel connected to the power shaft, the cam wheel driving the partition member between its first and second positions.

6. A rotary engine as recited in claim 1, wherein the partition member comprises an elongated bar having opposed parallel sliding surfaces, the partition member slot being formed between the opposed parallel surfaces at an intermediate longitudinal position along the elongated bar.

7. A rotary engine as recited in claim 1, further comprising two of said rotors mounted on the power shaft, the working members of the rotors being angularly aligned with each other with respect to the central axis.

8. A rotary engine as recited in claim 1, wherein the rotor comprises a central disk, the working member being positioned radially outward of the central disk.

9. A rotary engine comprising:

at least one engine block having first and second annular working chambers formed about first and second parallel central axes;

first and second power shafts mounted coaxially with the first and second central axes, respectively, for rotation within the at least one engine block;

first and second rotors connected to the first and second power shafts, respectively, the first rotor including a first working member positioned to travel in a circular path about the first central axis through the first annular working chamber, the second rotor including a second working member positioned to travel in a circular path about the second central axis through the second annular working chamber;

a partition member mounted to extend across the first and second annular working chambers, the partition member being slidable between first and second positions, the partition member allowing passage of the working members when the partition member is in its first position;

the partition member including solid walls which are aligned with the first and second annular working chambers when the partition member is in its second position, the partition member thereby dividing the annular working chambers into expansion and exhaust chambers;

the first and second power shafts being drivingly connected to one another for synchronous movement in opposite rotational directions to equalize combustion forces from within the first and second working chambers.

10. A rotary engine as recited in claim 9, the annular working chambers and the working members having circular cross-sections of complementary diameter.

11. A rotary engine as recited in claim 9, the annular working chambers and the working members having circular cross-sections of complementary diameter, the rotary engine including circular sealing rings positioned around the working members to seal between the working members and the annular working chambers.

12. A rotary engine as recited in claim 9, the annular working chambers and the working members having circular cross-sections of complementary diameter, the rotary engine further comprising:

circular sealing rings positioned around the working members to seal between the working members and the annular working chambers;

counterweight assemblies connected to segments of the circular sealing rings to offset centrifugal forces produced by the sealing ring segments, each counterweight assembly comprising a cylindrical counterweight having a longitudinal axis, the cylindrical counterweight being received within a complementary cylindrical bore in one of the working members to allow rotation of the counterweight about its longitudinal axis in response to centrifugal forces.

13. A rotary engine as recited in claim 9, further comprising a cam wheel drivingly connected for rotation with both of the power shafts, the cam wheel driving the partition member between its first and second positions.

14. A rotary engine as recited in claim 9, wherein the partition member comprises a pair of elongated bars having opposed parallel sliding surfaces, a slot being formed between the opposed parallel sliding surfaces of each elongated bar at an intermediate longitudinal position along the elongated bar to allow passage of the working members.

15. A rotary engine as recited in claim 9, wherein each rotor comprises a central disk, each working member being positioned radially outward of the corresponding central disk.

16. A rotary engine as recited in claim 9, the working members each having a leading surface and a trailing surface, the leading and trailing surfaces being angled so that the leading surface gradually enters a partition member slot as the partition member slides to its first position and so that the trailing surface gradually exits the partition member slot as the partition member slides to its second position.

17. A rotary engine as recited in claim 9, further comprising:

a pair of the first annular working chambers formed about the first central axis;

a pair of the second annular working chambers formed about the second central axis;

a pair of the first rotors connected to the first power shaft, the first working members of the first rotors being positioned to travel in circular paths about the first central axis within the first annular working chambers;

a pair of the second rotors connected to the second power shaft, the second working members of the second rotors being positioned to travel in circular paths about the second central axis within the second annular working chambers;

a pair of the partition members, a first of the partition members extending across one of the first working chambers and one of the second working chambers, a second of the partition members extending across another of the first working chambers and another of the second working chambers, the partition members being symmetrically opposed to each other along the first and second central axes; and a cam wheel drivingly connected for rotation with the power shafts, the cam wheel connected to drive both of the partition members between their first and second positions.

18. A rotary engine as recited in claim 9, further comprising:

a pair of the first annular working chambers formed about the first central axis;

a pair of the second annular working chambers formed about the second central axis;

a pair of the first rotors connected to the first power shaft, the first working members of the first rotors being positioned to travel in circular paths about the first central axis within the first annular working chambers;

a pair of the second rotors connected to the second power shaft, the second working members of the second rotors being positioned to travel in circular paths about the second central axis within the second annular working chambers;

a pair of the partition members, a first of the partition members extending across one of the first working chambers and one of the second working chambers, a second of the partition members extending across another of the first working chambers and another of the second working chambers, the partition members being symmetrically opposed to each other along the first and second central axes; and a cam wheel drivingly connected for rotation with the power shafts, the cam wheel being connected to drive both of the partition members in opposing directions between their first and second positions.

19. A rotary engine comprising:

an engine block having first and second annular working chambers formed about first and second parallel central axes;

first and second power shafts mounted coaxially with the first and second central axes, respectively, for rotation within the engine block;

first and second rotors connected to the first and second power shafts, respectively, the first rotor including a first working member positioned to travel in a circular path about the first central axis through the first annular working chamber, the second rotor including a second working member positioned to travel in a circular path about the second central axis through the second annular working chamber;

a partition member mounted within the engine block to extend across the first and second annular working chambers, the partition member being slidable between first and second positions;

the partition member including slots which are aligned with the first and second annular working chambers when the partition member is in its first position to allow passage of the working members therethrough;

a cam wheel which is drivingly connected to at least one of the power shafts for synchronous rotation therewith, the cam wheel engaging the partition member to reciprocate the partition member between its first and second positions;

the first and second power shafts being drivingly connected to one another for synchronous movement in opposite rotational directions to equalize combustion forces from within the first and second working chambers.

20. A rotary engine as recited in claim 19, the annular working chambers and the working members having circular cross-sections of complementary diameter.

21. A rotary engine as recited in claim 19, the annular working chambers and the working members having circular cross-sections of complementary diameter, the rotary engine further comprising:

circular sealing rings positioned around the working members to seal between the working members and the annular working chambers;

magnets positioned within the partition member to draw the circular sealing rings into contact with the partition member.

22. A rotary engine as recited in claim 19, the annular working chambers and the working members having circular cross-sections of complementary diameter, the rotary engine further comprising:

circular sealing rings positioned around the working members to seal between the working members and the annular working chambers;

counterweight assemblies connected to segments of the circular sealing rings to offset centrifugal forces produced by the sealing ring segments, each counterweight assembly comprising a cylindrical counterweight having a longitudinal axis, the cylindrical counterweight being received within a complementary cylindrical bore in one of the working members to allow rotation of the counterweight about its longitudinal axis in response to centrifugal forces.

23. A rotary engine as recited in claim 19, wherein the partition member comprises an elongated bar having opposed parallel sliding surfaces, one of said partition member slots being formed between the opposed parallel surfaces at an intermediate longitudinal position along the elongated bar, the rotary engine including an oil bath positioned around the parallel sliding surfaces of the partition member to lubricate and cool the partition member.

24. A rotary engine as recited in claim 19, the working members each having a leading surface and a trailing surface, the leading and trailing surfaces being angled so that the leading surface gradually enters the partition member slot as the partition member slides to its first position and so that the trailing surface gradually exits the partition member slot as the partition member slides to its second position.

25. A rotary engine as recited in claim 19, wherein each rotor comprises a central disk, each working member being positioned radially outward of the corresponding central disk.

26. A rotary engine as recited in claim 19, further comprising:

a pair of the first annular working chambers formed about the first central axis;

a pair of the second annular working chambers formed about the second central axis;

a pair of the first rotors connected to the first power shaft, the first working members of the first rotors being positioned to travel in circular paths about the first central axis within the first annular working chambers;

a pair of the second rotors connected to the second power shaft, the second working members of the second rotors being positioned to travel in circular paths about the second central axis within the second annular working chambers;

a pair of the partition members, a first of the partition members extending across one of the first working chambers and one of the second working chambers, a second of the partition members extending across another of the first working chambers and another of the second working chambers, the partition members being symmetrically opposed to each other along the first and second central axes; and the cam wheel operably engaging both of the partition members to drive them between their first and second positions.

27. A rotary engine as recited in claim 19, further comprising:

a pair of the first annular working chambers formed about the first central axis;

a pair of the second annular working chambers formed about the second central axis;

a pair of the first rotors connected to the first power shaft, the first working members of the first rotors being positioned to travel in circular paths about the first central axis within the first annular working chambers;

a pair of the second rotors connected to the second power shaft, the second working members of the second rotors being positioned to travel in circular paths about the second central axis within the second annular working chambers;

a pair of the partition members, a first of the partition members extending across one of the first working chambers and one of the second working chambers, a second of the partition members extending across another of the first working chambers and another of the second working chambers, the partition members being symmetrically opposed to each other along the first and second central axes; and the cam wheel operably engaging both of the partition members to drive them in opposing directions between their first and second positions.

* * * * *